US005504505A

United States Patent [19]

Tamura et al.

[11] Patent Number: 5,504,505

[45] Date of Patent: Apr. 2, 1996

[54] INK JET RECORDING HEAD AND DRIVING CIRCUIT THEREFOR

[75] Inventors: Yasuyuki Tamura, Yokohama; Masafumi Wataya, Kawasaki, both of Japan

[73] Assignee: Canon Kabushiki Kaisha, Tokyo, Japan

[21] Appl. No.: 801,549

[22] Filed: Dec. 2, 1991

[30] Foreign Application Priority Data

Nov. 30, 1990 [JP] Japan ..... 2-329734
Nov. 30, 1990 [JP] Japan ..... 2-335231

[51] Int. Cl.[6] ..... B41J 2/05

[52] U.S. Cl. ..... 347/13

[58] Field of Search ..... 346/1.1, 140 R, 346/76 PH; 307/254, 255, 262, 270, 446, 454, 456, 125; 347/12, 13, 180, 181, 182, 57

[56] References Cited

U.S. PATENT DOCUMENTS

| | | | |
|---|---|---|---|
| 3,155,963 | 11/1964 | Boensel | 307/255 |
| 3,984,844 | 10/1976 | Tanno et al. | 346/76 R |
| 4,091,391 | 5/1978 | Kozima et al. | 346/76 R |
| 4,313,124 | 1/1982 | Hara | 346/140 R |
| 4,345,262 | 8/1982 | Shirato et al. | 346/140 R |
| 4,353,079 | 10/1982 | Kawanabe | 346/140 R |
| 4,459,600 | 7/1984 | Sato et al. | 346/140 R |
| 4,463,359 | 7/1984 | Ayata et al. | 346/1.1 |
| 4,511,809 | 4/1985 | Allen | 307/254 |
| 4,544,934 | 10/1985 | Owada et al. | 307/255 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,791,320 | 12/1988 | Kawata et al. | 307/454 |
| 4,829,201 | 5/1989 | Masuda et al. | 307/454 |
| 4,931,813 | 6/1990 | Pan et al. | 346/140 R |

FOREIGN PATENT DOCUMENTS

| | | | |
|---|---|---|---|
| 0372895 | 6/1990 | European Pat. Off. . | |
| 2714482 | 10/1977 | Germany . | |
| 49-105544 | 10/1974 | Japan . | |
| 54-056847 | 5/1979 | Japan . | |
| 56-123880 | 9/1981 | Japan . | |
| 59-123670 | 7/1984 | Japan . | |
| 59-138461 | 8/1984 | Japan . | |
| 60-071260 | 4/1985 | Japan . | |
| 62-246746 | 10/1987 | Japan . | |
| 62-290557 | 12/1987 | Japan . | |
| 01038245 | 2/1989 | Japan . | |
| 3-246048 | 11/1991 | Japan | B41J 2/05 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording head includes a plurality of heat generating elements for ejecting ink using thermal energy; a conductive line commonly connected to an end of each of the heat generating elements and to another end of adjacent heat generating element; a driving circuit for selectively providing positive or negative current to the common lines, the driving circuit actuates the heat generating elements by applying a high level potential and a low level potential to adjacent lines, respectively.

30 Claims, 15 Drawing Sheets

INK JET RECORDING HEAD AND DRIVING CIRCUIT THEREFOR

FIELD OF THE INVENTION AND RELATED ART

The present invention relates to an ink jet recording head using thermal energy and a driving circuit therefor and also to a recording apparatus usable with the recording head.

A recording apparatus such as a printer, copying machine or facsimile machine is responsive to image information to effect recording corresponding thereto with dot patterns on a recording material such as a sheet of paper or a thin sheet of plastic material. The recording apparatus may be classified on the basis of the recording process into an ink jet type, a wire dot type, a thermal type and a laser beam type or the like. Among these, the ink jet type (film-boiling type) and thermal type (thermal transfer type or heat sensitive type), uses a recording head which effects recording using the thermal energy produced by an electrothermal transducer (heat generating element). In the ink jet type (ink jet recording apparatus), droplets of ink (recording liquid) are ejected through ejection outlets of the recording head, and are deposited as dots on the recording material.

An ink jet recording apparatus using the thermal energy to heat the ink to such an extent that the ink is ejected, is advantageous in that the structure of each of the ejection outlets of the recording head is simple, that the size of the recording head can be easily reduced and that a number of ejection outlets can be formed integrally. The respective ejection outlets (liquid passages) are usually provided with one respective heating element (electrothermal transducer). Therefore, the conventional ink jet recording head has several tens of ejection outlets as a unit, so as to perform high speed and high density recording.

In order to eject the ink efficiently in the recording head of this type using the thermal energy, it is desirable that the heat generating element is quickly heated, that is, in a short period of time. Additionally, it is driven with a current pulse having a short length such as several microseconds. This results in a large current upon driving. If plural heat generating elements are connected with a fine common wiring pattern, the voltage drop along the common line is so large that the driving conditions vary depending on the number of elements simultaneously driven. In view of this, it is conventional that two lines (positive and negative lines) are provided for each of the heat generating elements.

In the conventional ink jet recording head using thermal energy, electrochemical reaction occur on the surfaces of the heat generating elements and the surfaces of the wiring pattern. In order to prevent damage due to these reaction, strong protective layers of insulating material are used.

The conventional ink jet recording head using the thermal energy requires two wiring lines for each of the heat generating elements in the recording head. This requires thin wiring patterns necessarily having high electrical resistance. This increases the heat generation in the recording head.

Additionally, it requires a large number of wiring patterns, which limits the ejection outlet arrangement density, which imposes limitations increases in the density of the image.

As described, the conventional ink jet recording head using thermal energy requires the strong protective layers of insulating material. However, if the projective layer has a pin hole, even if it is small in size, the positive or negative potential is repeatedly applied at the pin hole with the result of corrosion, which may lead to damage of the recording head.

To prevent this, the protective layer has to be made sufficiently thick. Then, even when the heat generating element is strongly heated, the heating action to the ink is rather dull, so that the ink ejection force is not increased enough. In addition, high viscosity ink is not usable. When the ink solvent evaporates, the ink may not be ejected.

In the Japanese Patent Application Publication No. 38245/1989, the energy required for the creation of a bubble is divided into plural pulses, and a constant potential is applied to the common electrode, while positive or negative (negative to the common electrode) potential is applied to selected electrodes to drive the heater. This method seems to be advantageous in the prevention of the electrochemical reaction, but the problems of voltage drop due to the resistance of the wiring pattern and the heat generation in the recording head are not solved. It also involves the problem that plural driving sources are required to apply the positive and negative potentials with the result of bulky and complicated apparatus.

U.S. Pat. No. 4,463,359 discloses a staggered arrangement of the heat generating elements. In order to drive the heat generating elements, the method disclosed in Japanese Patent Application Publication No. 105544/1974 or U.S. Pat. No. 3,984,844 can be used. Then, the number of lines can be reduced. However, since the direction of the potential application is limited to one, this does not avoid problems due to the electrochemical reaction.

In addition, there occurs crosstalk inherent to a diode matrix circuit or the like with the result by slight heat generation of non-driven elements, and therefore, the heat generation in the recording head increases.

In a so-called thermal head used with the heat sensitive recording process, Japanese Laid-Open Patent Application Publication No. 290557/1987 discloses wiring having lines, the number of which is larger by one than the number of heat generating elements, to drive the heat generating elements, with the non-constant direction of the electric current.

When this method is used for an ink jet recording head using the thermal energy, the electric current flowing through the wiring is not constant, and therefore, the voltage drop due to the wiring varies case by case, and therefore, the driving conditions for the heat generating elements are not constant. When this method is used, it is required that all of the heat generating elements are driven simultaneously. Therefore, there is the problem of a large current flowing at once.

With the thermal recording system, the heat generating element is driven by a relatively small current having a relatively long pulse, and therefore, the instantaneous current level is not significant. However, in the case of the ink jet recording head using thermal energy, even in the case of driving at frequencies of several kHz, the power supply period of the heat generating element is several micro-seconds—10 micro-seconds. The energy sufficient to eject the ink is applied in such a small period, and therefore, the current flowing instantaneously is extremely large.

SUMMARY OF THE INVENTION

It is a principal object of the present invention to provide an ink jet recording head and a driving circuit therefor wherein the voltage drop due to the wiring pattern is reduced, thus suppressing the heat generation in the head.

It is another object of the present invention to provide an ink jet recording head and a driving circuit therefor wherein the ejection outlets can be arranged at a higher density than conventional ones.

It is a further object of the present invention to provide an ink jet recording head and a driving circuit therefor wherein the service life of the recording head is made longer.

It is a yet further object of the present invention to provide an ink jet recording head and a driving circuit therefor wherein the ink ejection force and the ink ejection stability are enhanced in the case of using thermal energy.

It is a yet further object of the present invention to provide a bi-directional current switching circuit having a higher staple operating speed to fit the driving circuit for the ink jet recording head.

According to an aspect of the present invention, there is provided an ink jet recording head, having: a plurality of heat generating elements for ejecting ink using thermal energy; a conductive line commonly connected to an end of each of the heat generating elements and to another end of adjacent heat generating element; a driving circuit for selectively providing positive or negative current to the common lines, the driving circuit actuates said heat generating elements by applying a high level potential and a low level potential to adjacent lines, respectively.

According to this aspect, the number of the wiring patterns can be reduced to just one more than the number of the heat generating elements in the recording head.

Therefore, even in a high density thermal recording head, the width of the wiring pattern may be increased without increasing the current flowing through the wiring pattern. Therefore, the voltage drop due to the wiring resistance can be reduced.

In this structure, the polarity of the voltage applied to each of the lines is not constant but is different depending on the number of elements energized between the reference line determining the potential level of a line at an instant and the line. The reference line is not necessarily disposed at an end.

Normally, the damage caused by these electrochemical reactions proceeds at only one of the positive and negative electrodes. It is dependent on the material of the electrode or the composition of the ink. According to the present invention, the polarity changes randomly except for the reference line, and therefore, the electrochemical reaction proceeds slowly, and therefore, the service life of the recording head is extended.

As regards the reference line and the heat generating element connected thereto, there is a possibility that the electrochemical reaction develops. However, this does not occur if there is no pinhole or other defect in the protective film, and therefore, the service life is normally extended.

Since the potential of the reference line may be either the high level or the low level, and by changing, the potential of the reference line may be, the electrochemical reaction proceeds slowly.

In addition, the potential of the reference line may be changed in a period shorter than the driving period for one driving pulse. In this case, the potential of all of the lines changes in accordance with the potential of the reference line. When the potential is changed at such a high speed, the change of the potential occurs more quickly than the dispersion time of the ions produced by the electrochemical reaction, and therefore, the caused by the electrochemical reaction is remarkably suppressed.

According to another aspect of the present invention, there is provided a bi-directional current switching circuit, comprising: complementary switching elements; and an impedance element for controlling on and off timing of the complementary switching elements.

According to a further object of the present invention, there is provided a driving circuit, comprising: a first bi-directional current switching circuit including complementary switching elements and an impedance element for controlling on and off timing of the complementary switching elements; a second bi-directional current switching circuit for effecting complementary switching operation with the first bi-directional current switching circuit; and a load connected between the first and second current switching circuits.

According to these aspects of the present invention, the impedance element is effective to control the on and off timing of complementary switching elements, and therefore, the complementary switching elements are protected from an excessive short-circuit current, and therefore, the operating speed can be stably increased.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Referring to the accompanying drawings, the preferred embodiments of the present invention will be described in detail.

Figure 9:
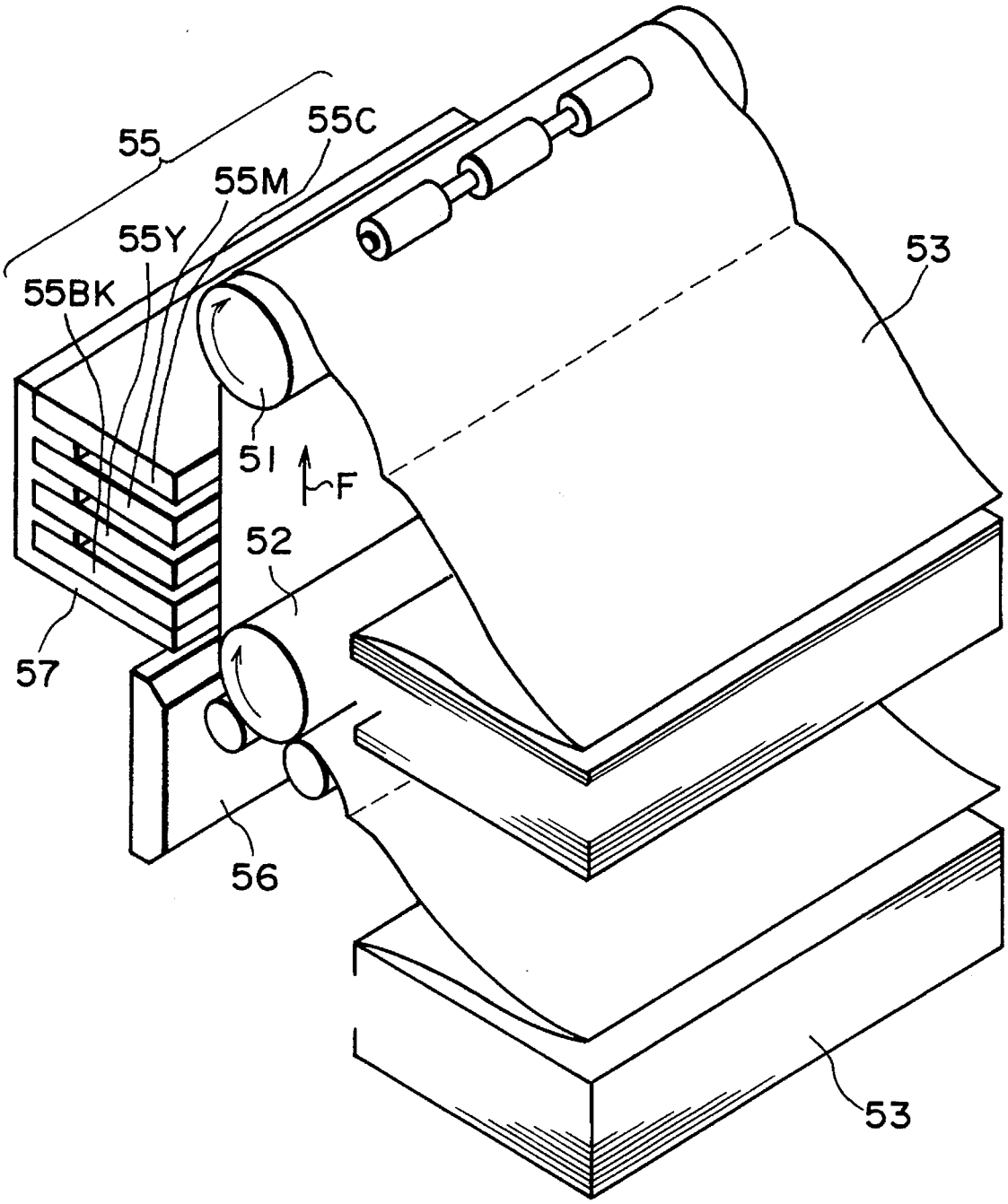
FIG. 9 is a schematic perspective view of an embodiment of a recording apparatus according to an embodiment of the present invention.

Referring first to FIG. 9, there is shown a part of a recording head using thermal energy, according to an embodiment of the present invention. The recording head is a line type and usable with a full-color ink jet recording apparatus having four such recording heads.

In FIG. 9, rollers 51 and 52 constituting a pair function to grip the recording material 53 such as a sheet of paper or plastic sheet therebetween and to feed it in the sub-scan direction (feeding direction) indicated by an arrow F. A full-multi-nozzle type ink jet recording head 55 comprises black, yellow, magenta and cyan recording heads 55BK, 55Y, 55M and 55C in which the ejection outlets are disposed covering across the entire width of the recording material 53.

In the case of full-color recording, the four recording heads 55 contain black, yellow, magenta and cyan ink materials, respectively. In the embodiment shown in the Figure, the four recording heads 55 are arranged in the order named from the upstream side of the recording material feeding direction (from the bottom).

A recovery system 56 faces the recording head 55 in place of the recording material 53 during the ejection recovery operation. The recording head 55 is mounted on the head mounting portion 57 with the predetermined relative relationship therebetween. The recording head 55 is of a thermal energy type, as will be described hereinafter.

The recording apparatus according to this embodiment of the present invention comprises the head mounting portion 57 for mounting the recording head 55 and feeding means 51 and 52 for feeding the recording material 53 to the recording position of the recording head 55 mounted on the recording head mount 57.

Figure 10:
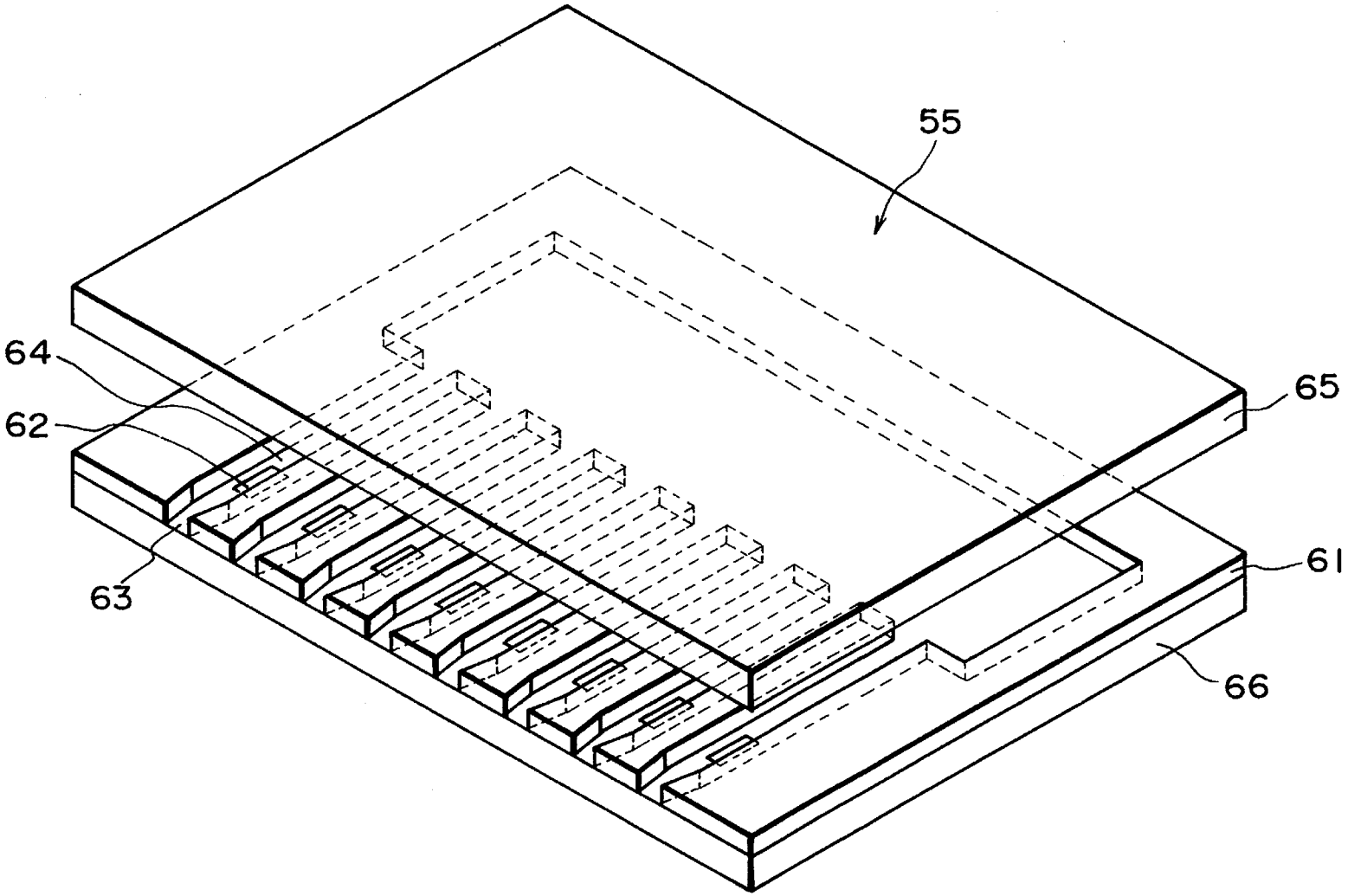
FIG. 10 is a schematic exploded perspective view of a recording head according to an embodiment of the present invention.

FIG. 10 is a schematic perspective view of an example of an ink jet type recording head. The ink jet recording head 55 is of a type using thermal energy and is provided with electrothermal transducer elements for producing the thermal energy. The recording head 55 ejects the ink through the ejection outlets by development of a bubble created by film boiling caused by the thermal energy applied to the ink by the electrothermal transducer.

In FIG. 10, the recording head comprises a silicon (Si) substrate 61, plural heat ejection elements (electrothermal transducer elements) formed at predetermined positions on the substrate, ejection outlets for ejection of ink droplets, corresponding to the respective heat generating elements, liquid passages 64 in which the heat generating elements are formed, a top plate 65 made of glass or the like to constitute a top board of the liquid passage 64, and a supporting plate 66 made of aluminum or the like mounted by bonding agent to the substrate 61. The heat generating element 62 is directly contactable to the ink in the liquid passage 64, but it is usually covered with a thin protective layer (insulating layer). The density of the arrangement of the heat generating element 62 is dependent on the desired recording density, but it is usually 3–30 elements per 1 mm.

In order to provide a practical recording speed using the ink jet recording head, each of the heat generating elements 62 is supplied with driving electric energy in the form of a pulse in accordance with an image signal at a frequency of several hundreds—several ten thousands per second (0.1 kHz–10 kHz of the driving frequency). In response to the electric energy, the heat generating element or elements are energized to produce heat to create a bubble or bubbles of the ink in the liquid passage 64. The ink is ejected through the ejection outlet 63 by the pressure of the bubble, and therefore, the image is recorded on the recording surface of the recording material 53.

Figure 1:
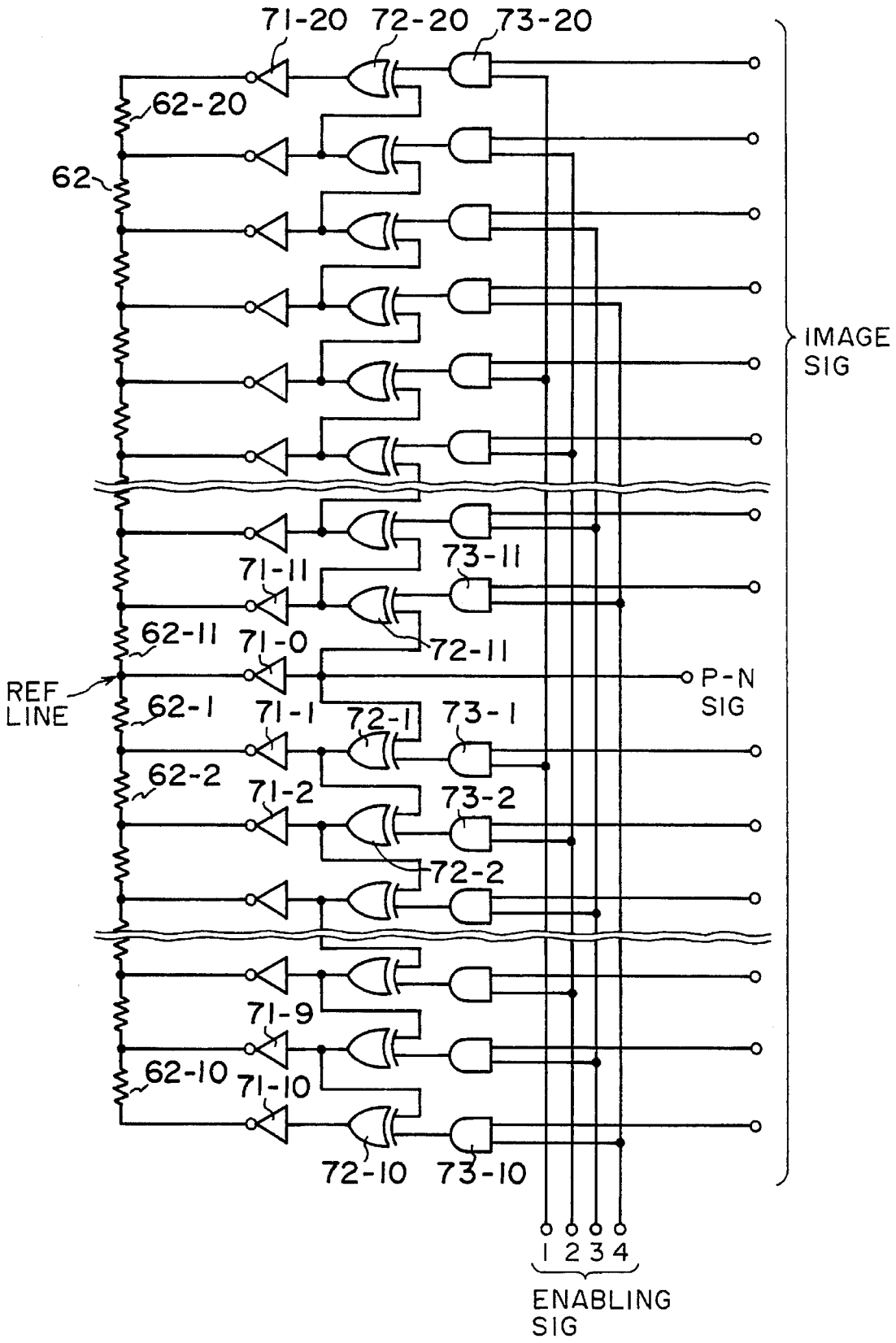
FIG. 1 is a circuit diagram of a driving circuit of a recording head according to an embodiment of the present invention.
Figure 2:
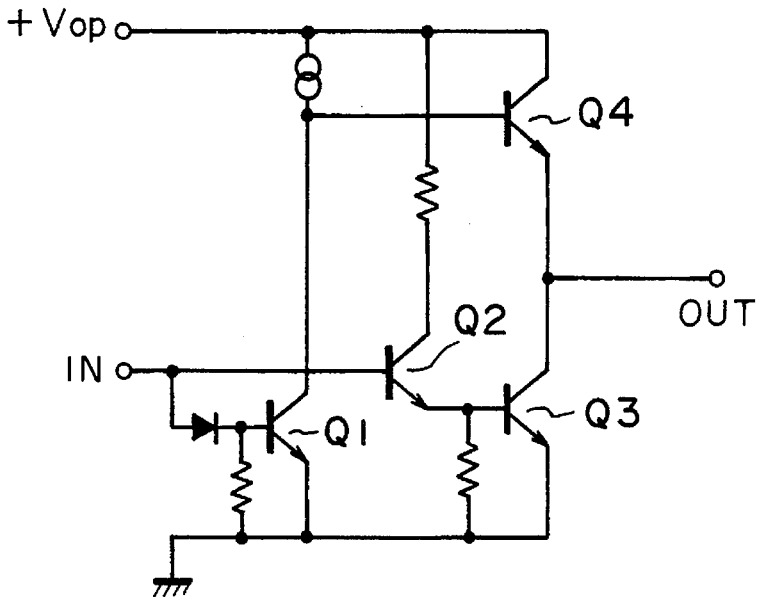
FIG. 2 is a circuit adjacent an output part of the circuit of FIG. 1.
Figure 3:
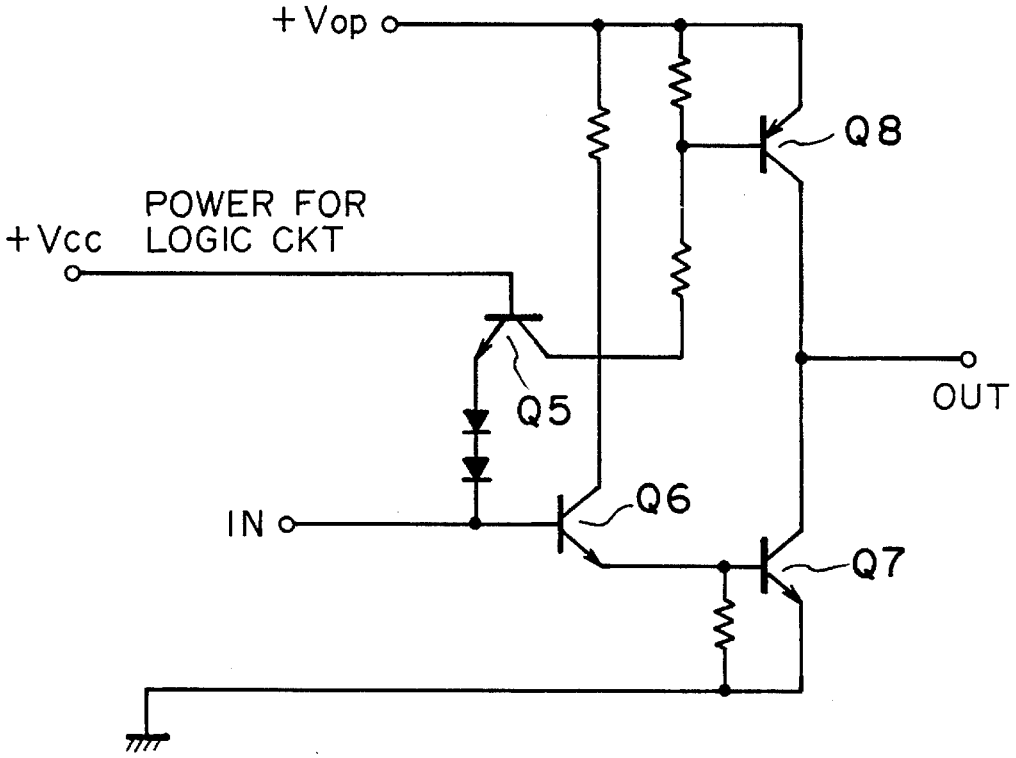
FIG. 3 shows another example of the output part circuit of FIG. 1.
Figure 4:
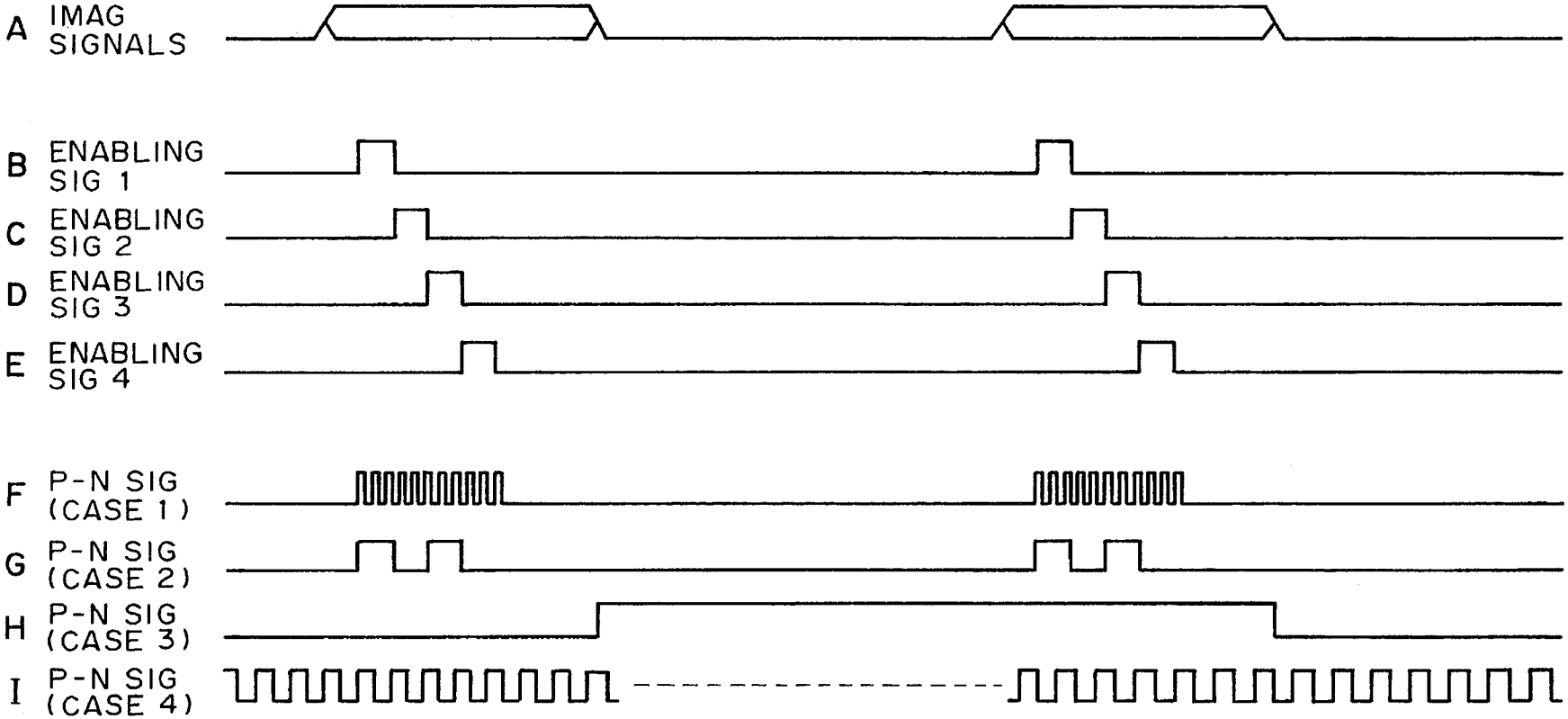
FIG. 4 is a timing chart for the signals of the driving circuit of FIG. 1.

FIG. 1 shows an example of a driving circuit of the recording head 55. FIGS. 2 and 3 show the output part of the circuit of FIG. 1. FIG. 4 is a timing chart for the signals applied to the circuit of FIG. 1.

In FIG. 1, the heat generating elements 62-1–62-10 are connected in series, each end of each of the elements is connected to an output driver in the form of an inverter 71-0–71-10. The inverters 71-1–71-10 are supplied with the outputs of exclusive-OR circuits 72-1–72-10. The inverter 71-0 is supplied with positive and negative signals. To one end of inputs of each of the exclusive OR circuit 72-1–72-10, an AND-circuit 73-1–73-10 is connected. To another end of each of the exclusive-OR circuit 72-1–72-10, an input of each of the inverters 71-0–71-9 is similarly supplied. To one of the inputs of each of the AND-circuits 73-1–73-10, an image signal is supplied, and to the other input, an enabling signal for the block drive control is supplied. The same structures are used in the heat generating elements 62-11–62-20, inverters 71-11–71-20, exclusive-OR circuits 72-11–72-20, and the AND-circuit 73-11–73-20.

In this structure, the AND-circuit 73-1–73-10 produces an "H" level signal when both of the image and enabling signals are at "H" levels. The produced "H" level signal is supplied to the one of the inputs of the exclusive-OR circuit 72-1–72-10. The exclusive-OR circuit 72-1–72-10 to which the "H" level is input at one of its input ends functions as an inverter for inverting the input signal to the other input. In the exclusive-OR circuits 72-1–72-10 supplied with "L" level signal permits the input to the other input part as it is.

When the output of the AND-circuit 73-1– 73-10 is at "H" level, the output of the inverter 71-1–71-10 acquires the polarity opposite from that of the output of the associated inverter 71-0–71-9, so that the electric current flows through the heat generating element 62-1–62-10. When the output of the AND-circuit 73-1–73-10 is at "L" level, the output of the inverter 71-1–71-10 acquires the polarity which is the same as that of the output of the inverter 71-0–71-9, so that the electric current does not flow through the heat generating element 62-1–62-10. If the polarity of the signal to the inverter 71-0 is switched, the direction of the electric current flowing through the heat generating element 62-1–62-10 is inverted.

In this embodiment, the plural heat generating elements 62 are divided into four blocks in accordance with the heat generating timing.

The image signals are supplied in parallel from a register or latching circuit (not shown), and when the pulses are applied sequentially in response to the enabling signals, the heat generating elements 62 in each of the blocks are driven in accordance with the image signals. The output parts shown in FIGS. 2 and 3 correspond to the inverter 71 of FIG. 1 and are capable of producing positive and negative direction electric currents corresponding to the digital signals. In FIGS. 2 and 3, +Vop shows the voltage applied to the heat generating element 62 and is determined in accordance with the resistance of the heat generating elements and the design conditions for the recording head or the like. It is usually 20–30 V. In the same Figure, +Vcc shows a logic circuit voltage source and usually produces 5–6 V.

In FIG. 2, when the "H" level signal is supplied to the input IN, the transistor Q1 is rendered conductive, upon which transistors Q2 and Q3 are rendered conductive. On the other hand, in response to the transistor Q1 actuated, the base of the transistor Q4 becomes "L" level, and therefore, the transistor Q4 is turned off. Therefore, the output OUT produces "L" level to permit electric current from the output OUT.

When the "L" level signal is supplied to the input IN, the transistors Q1, Q2 and Q3 are turned off, upon which the transistor Q4 is turned on. Therefore, the "H" level is produced at the output OUT, so that the electric current flows out of the output OUT.

Thus, the circuit shown in FIG. 2 functions as an inverter in which signal produced at the output OUT is opposite from the signal at the input end IN, and also, it functions as a bi-directional current switching circuit.

The operation of FIG. 3 circuit is similar. When "H" level signal is inputted to the input IN, the transistors Q6 and Q7 are actuated, upon which the transistors Q5 and Q8 are turned off, and therefore, "L" level is produced at the output OUT. On the other hand, when the "L" level signal is inputted, the transistors Q6 and Q7 are turned off, so that the transistors Q5 and Q8 are actuated with the result of the "H" level is produced at the output. Thus, the circuit of FIG. 3 functions as an inverter and also as a bi-directional current switching circuit.

As shown in FIG. 4, plural image signals (FIG. 4A) are simultaneously supplied to the image signal input, while the pulse signals are sequentially applied as the enabling signals 1–4 (FIGS. 4B, 4C, 4D and 4E). The heat generating element 62 is thus energized for the period corresponding to the associated pulse width. The pulse width of the enabling signals 1–4 is usually 1 micro-sec.-10 micro-sec.

As for the positive-negative signal, as shown in FIGS. 4F–4I (case 1–case 4), various schemes are possible.

In case 1, when the heat generating element 62 is driven, such a high frequency signal changes several times in the time period of the pulse width for which the enabling signal is applied. In this case, in each of the heat generating elements, the direction of the electric current changes several times in the period of one driving pulse (one period having positive and negative phases), and therefore, the electrochemical reaction is effectively prevented. However, since the driving is at the high frequency, and therefore, the response speed in the entire circuit is sufficiently high, This results in a large electric power loss in the driving circuit.

In case 2, in synchronism with the enabling signal, the positive and negative signals change. In case 3, the positive-negative signal changes for each of one image signal record. In the method of cases 2 and 3, there is no problem with the response speed of the driving circuit. From the standpoint of preventing the electrochemical reaction, they are less effective than in case 1, but the advantageous effects are still enough.

In case 4, the pulses are applied irrespective of the image signal (FIG. 4A) and enabling signals (FIGS. 4B–4E). In this case, the potential of the wiring changes between the high level and the low level even when the heat generating element 62 is not driven. With such a driving system, there exists slight electric current leakage between the wiring and the heat generating element and the ink. Therefore, the potential of the ink is maintained at a level between the high level and the low level. Relative to the level of the ink, the potential of the electrode always changes between the positive and negative polarities, thus reducing the electrochemical reaction.

As for the scheme of the application of the positive-negative signals, various modifications are possible. It is possible to fix the polarity of the positive-negative signal. In such a case, the electrochemical reaction is possible in the reference line, and generally speaking, it is desirable to provide a separate means for preventing it.

Figure 5:
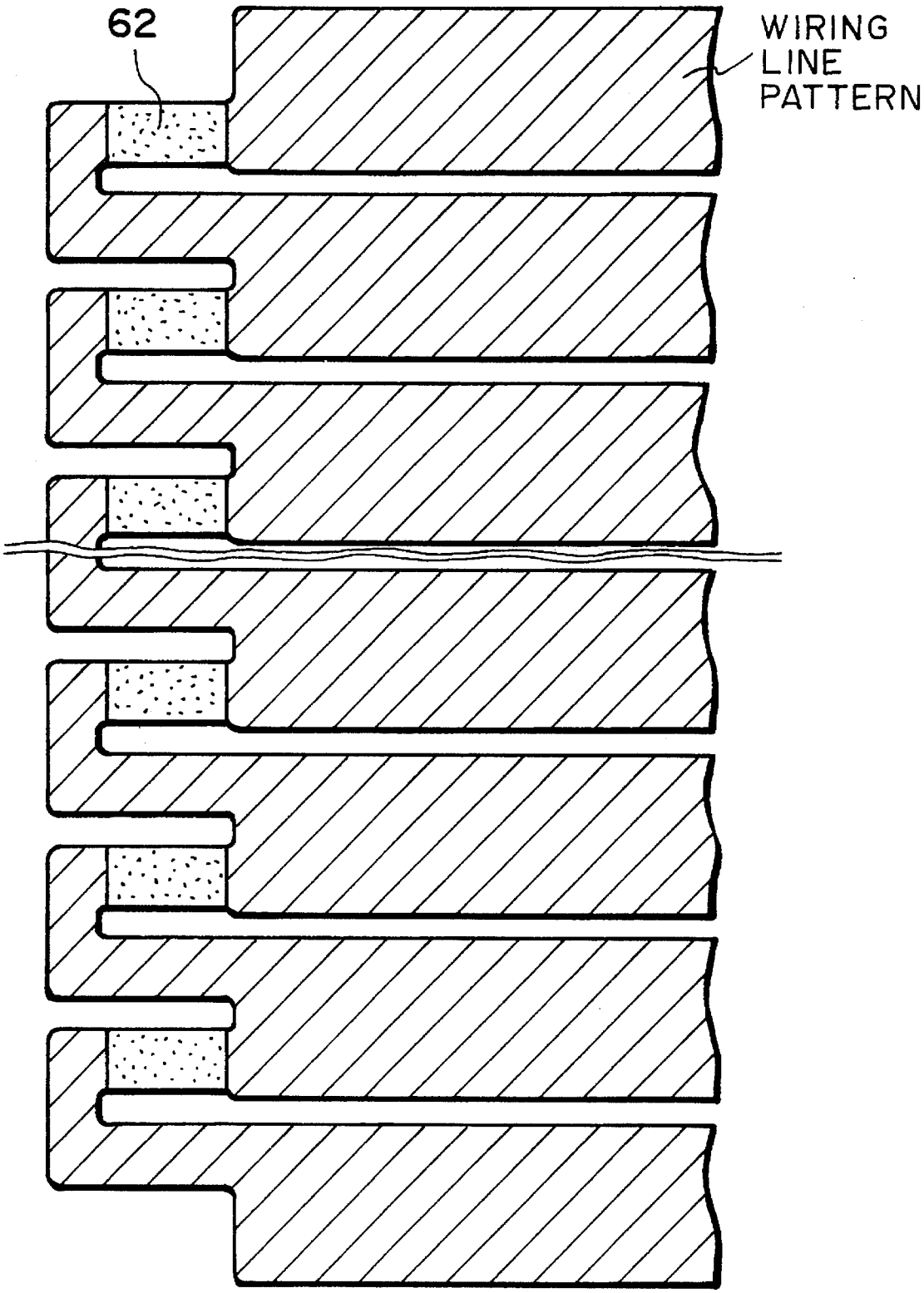
FIG. 5 is a schematic partial top plan view of an example of a wiring pattern for the heat generating elements and in the neighborhood thereof, of a recording head according to an embodiment of the present invention.
Figure 6:
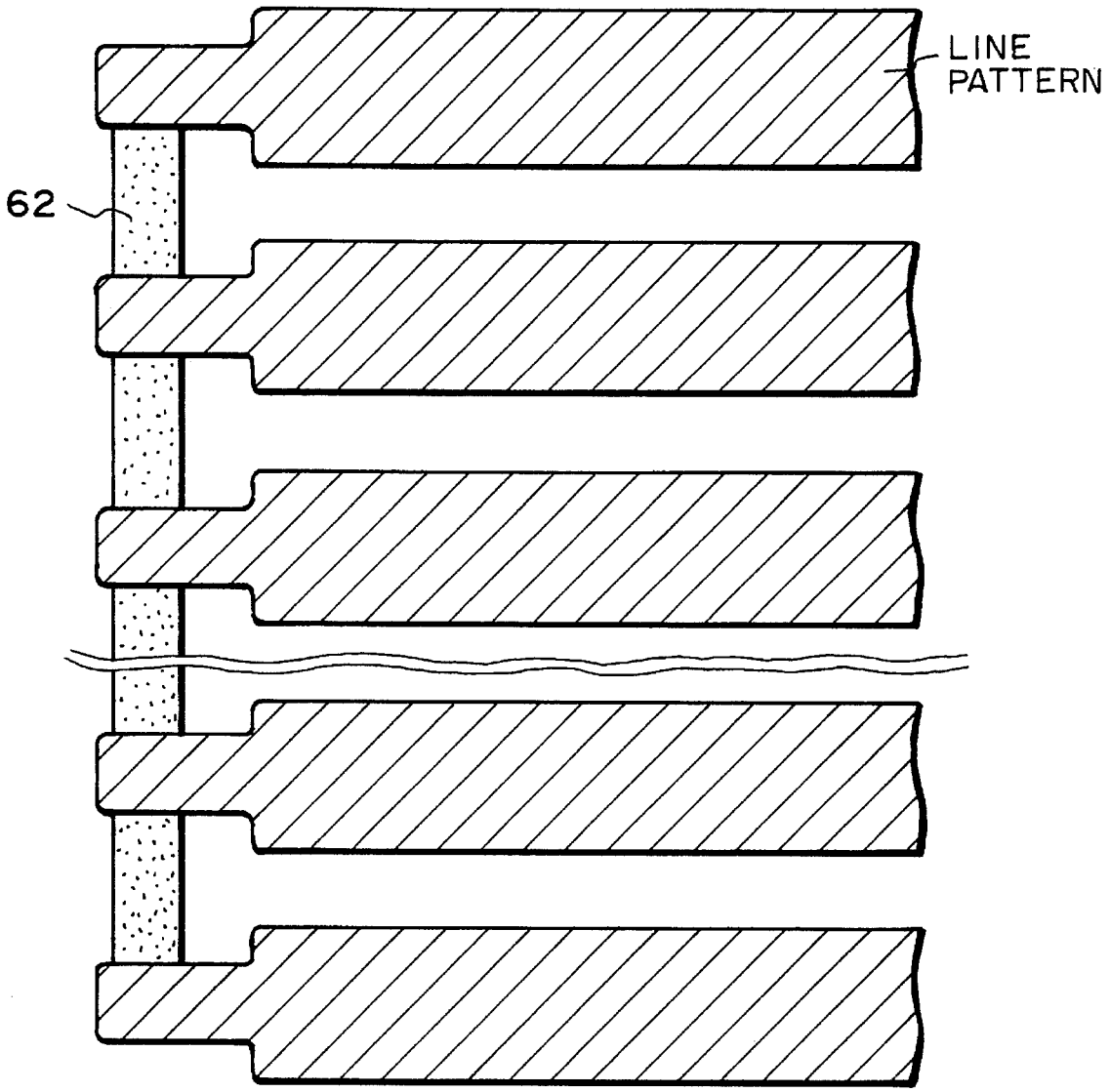
FIG. 6 is a schematic partial top plan view of another example of a wiring pattern for the heat generating elements and in the neighborhood thereof, of the recording head according to the present invention.

FIGS. 5 and 6 are schematic views of an example of the wiring pattern including the heat generating elements 62 in a recording head 55. In FIG. 5, the direction of the electric current in the heat generating element 62 is parallel with the direction of the wiring pattern, whereas in FIG. 6, they are orthogonal.

As will be understood in FIGS. 5 and 6, the width of the wiring pattern can be increased, thus decreasing the electric resistance of the wiring.

Such heat generating elements 62 and wiring pattern can be formed on a silicon substrate 61 through a thin film producing process, for example. Normally, on the heat generating elements 62 and the wiring pattern, a protective layer of $SiO_2$ or the like and an anti-cavitation layer of Ta or the like are provided. In this embodiment, the electrochemical reaction does not occur readily, and therefore, the thickness of the protective layer can be reduced.

If the heat generating elements 62 are made of high anti-cavitation material such as TaAl alloy or the like, the protective layer and the anti-cavitation layer can be omitted. As a result, the heat transfer between the heat generating element 62 and the ink increases so that the ink can be more quickly heated, by which the ink ejection power can be enhanced, and the stability and reproducibility of the ejection can be improved.

As will be apparent from FIGS. 5 and 6, the width of the wiring pattern can be increased in this embodiment, and therefore, the wiring resistance can be reduced even when the heat generating elements 62 are arranged at a higher density. In addition, the wiring pattern can be disposed only along one side of the line of the heat generating elements 62, and therefore, the distance between the end of the substrate 51 and the heat generating element 62 can be reduced, so that a higher performance thermal recording head can be designed.

Figure 7:
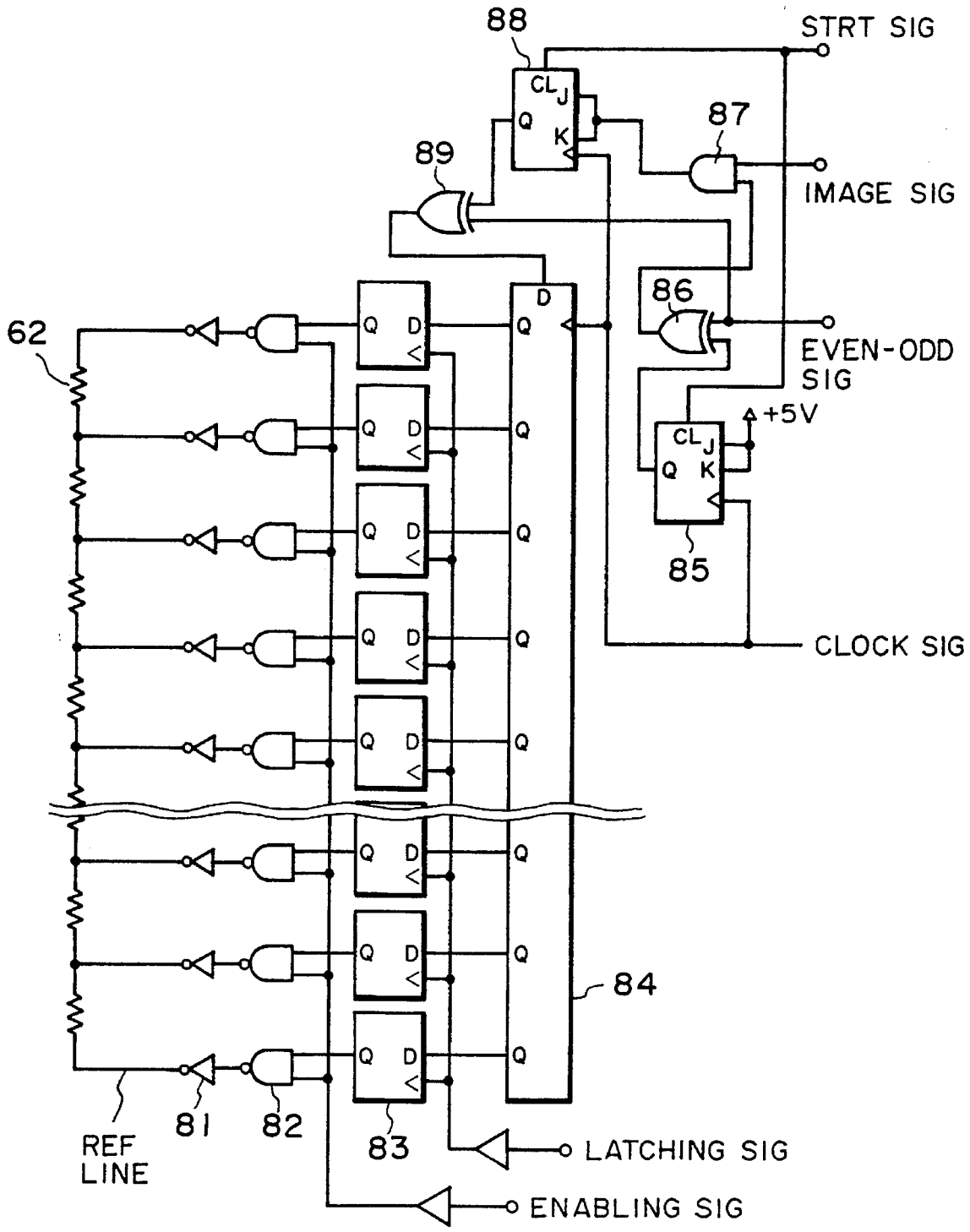
FIG. 7 shows a circuit diagram of a driving circuit of a recording head according to another embodiment of the present invention.
Figure 8:
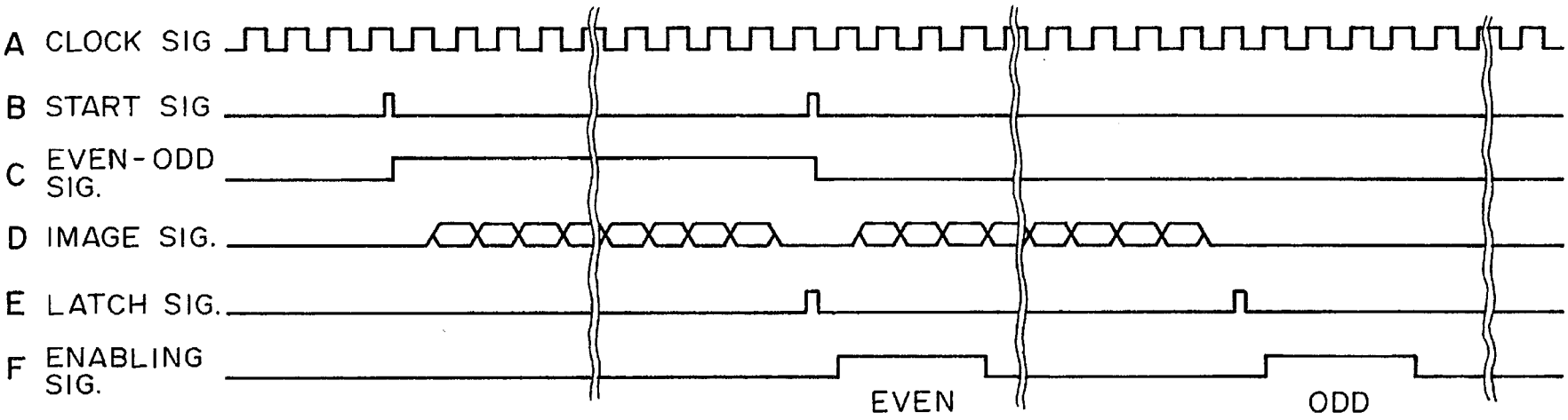
FIG. 8 is a timing chart of the signals of the driving circuit shown in FIG. 7.

FIG. 7 shows a circuit diagram of a driving circuit for a recording head according to another embodiment of the present invention. FIG. 8 is a timing chart for the signals for the circuit of FIG. 7. In the embodiment of FIGS. 1–4, at the opposite ends of the heat generating element 62 to be actuated, a high level potential and a low level potential are applied, respectively, while the signal is processed in parallel by the signal converting means. In this embodiment, the series process is used. In this embodiment, the image signals are classified into two blocks, one for the even number picture elements and the other for the odd number picture elements.

In FIG. 7, both ends of each of the heat generating elements 62 connected in series are connected with the associated inverter 81 functioning as output drivers. To each of the inverters 81, the output of the associated NAND circuit 82 is supplied. To one input end of each of the NAND circuit 82, the output of the associated latching circuit 83 is supplied, and the other input thereof is supplied with common enabling signal. To the data input part of the latching circuit 83 is supplied with the output of the shift register 84. The clock input is commonly supplied with the latching signal.

The flip-flop 85 is reset in response to a starting signal, and each time of the input of the clock signal, "H" or "L" level signals are alternately produced (½ frequency divider circuit). The output of the flip-flop 85 is reversed or not reversed in accordance with the polarity of the even-odd signal of the exclusive OR circuit 86. In response to the reverse-non-reverse output, the AND-circuit 87 masks the image signal. That is, the AND-circuit 87 outputs the image signals for either the even number signal or the odd number signal, in response to the polarity of the even-odd signal.

The flip-flop circuit 88 is reset in response to the start signal. Upon reception of the clock signal, the output of the flip-flop circuit 88 reverses its output when the output of the AND-circuit 87 is "H" level, and does not reverse it when the output of the AND-circuit 87 is "L" level. Thus, the flip-flop circuit 88 produces the signal of the level having the opposite polarity from that of the immediately output, when the output of the AND circuit 87 is at "H" level. The output of the flip-flop circuit 88 is reversed or non-reversed in accordance with the even-odd signal by the exclusive OR circuit 89, and is supplied to the shift register 84. Thus, when the even number or odd number image signal is at "H" level, the opposite polarity potentials are applied to the opposite ends of the corresponding heat generating element 62, so that the electric current flows through the heat generating element 62, which then generates heat.

In FIGS. 7 and 8, there is an interval corresponding to one clock signal (FIG. 8A) between the start signal (FIG. 8B) and the image signal supply (FIG. 8D). In response to the signal during this period, the potential of the reference line is supplied. In this embodiment, the logic circuit is such that the potential of the reference line changes for each of the blocks of the image signals.

In this circuit, in order for all of the ejection outlets of the recording head 5 to effect one recording, the same image signals are required to be supplied twice. With the first image signal supply with the even number signal (FIG. 8C), the image signals at the even numbers are recorded, and in response to the second image signals, the odd number images are recorded. More particularly, in FIG. 8, during the first enabling pulse period, the heat generating elements corresponding to the even numbered picture elements generate heat; and during the second enabling pulse period, the heat generating elements corresponding to the odd numbered picture elements are energized.

As for the circuit at the output part of FIG. 7 circuit, those shown in FIGS. 2 and 3 are usable. As for the heat generating element 62 and the wiring pattern, the structure shown in FIGS. 5 and 6 is usable.

In this embodiment, the number of the wiring patterns can be reduced to just one more than the number of the heat generating elements 62, in the driving circuit of the recording head 55. In addition, the electric current is not concentrated in on a particular wiring pattern or patterns, and therefore, the voltage drop through the wiring pattern can be reduced. This is effective to reduce the heat generation in the thermal recording head. Additionally, as compared with the conventional structure, the heat generating element can be arranged with higher density, and therefore, the density of the ejection outlets can be increased in the ink jet recording head. This permits fine image recording.

Furthermore, the progress of the electrochemical reaction on the wiring pattern and the heat generating elements can be suppressed, thus extending the service life of the recording head. Since the electrochemical reaction can be suppressed, it is possible to reduce the thickness of the protective layer on the heat generating element or the like, or it is possible to eliminate the protective layer. As a result, the ejection power for the ink is increased, and the stability of the ejection is improved. This is effective to enhance the reliability of the recording apparatus.

It is also possible to use a relatively high viscosity ink or the like which has not been used in the conventional apparatus. This increases the latitude in the selection of the ink material, and permits higher quality image recording. In this embodiment, the heat generating elements 62 are classified into plural blocks in the driving, and therefore, the total current for the entire circuit is reduced, and therefore, the power source for driving the heat generating elements can be made smaller.

In the foregoing embodiment, the description has been made with respect to the application for a recording apparatus using a recording head of full or partial line type covering the entire or a part of the recording width for the recording material. However, the present invention is applicable to the serial scanning type recording head capable of reciprocating in the direction of the width of the recording material or another type with the same advantageous effect. Furthermore, the present invention is applicable to the recording apparatus irrespective of the number of the recording heads.

This embodiment is particularly suited to driving a resistor directly contactable to the ink to be ejected. As an example of such a resistor, there is a resistor having been treated for high resistance without the protective layer.

Figure 11:
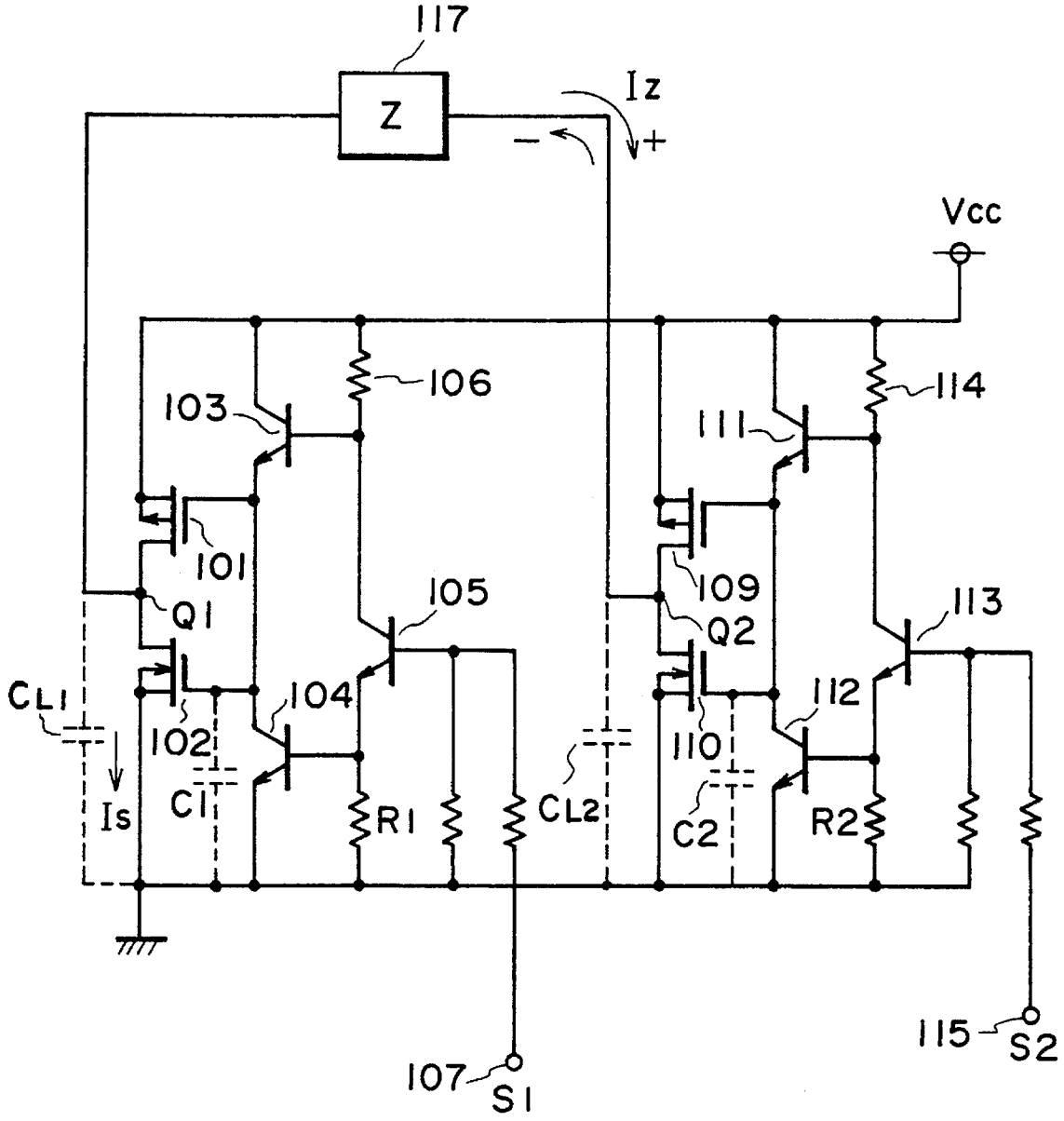
FIG. 11 is a circuit diagram of the output part in the form of a bi-directional current switching circuit, according to a further embodiment of the present invention.

Referring to FIG. 11, description will be made as to another example of the bi-directional current switching circuit usable with the inverter 71 of FIG. 1 and the inverter 81 of FIG. 7. FIG. 11 shows two switching circuits having the same structure. Each of them has a first inverter 103–105, 112–113 and a second inverter 101, 102, 109, 110 for reversing the output level of the first inverter. The load 117 in the form of a heat generating element is connected between the second inverters. The first inverter comprises a phase splitter and a totem pole amplifier, connected in series. The second inverter comprises pMOSFET 101, 109 and nMOSFET 102, 110 connected in series. With this structure, the input voltage level of the switching circuit is the same as the output voltage level. When the input S1 is supplied with the H signal while the input S2 is supplied with L signal, the load current for the load 117 flows in the direction from the output Q1 to the output Q2. On the other hand, when the input S1 is supplied with L signal while the input S2 is supplied with H signal, the load current flows in the direction from the output Q2 to the output Q1.

Figure 12:
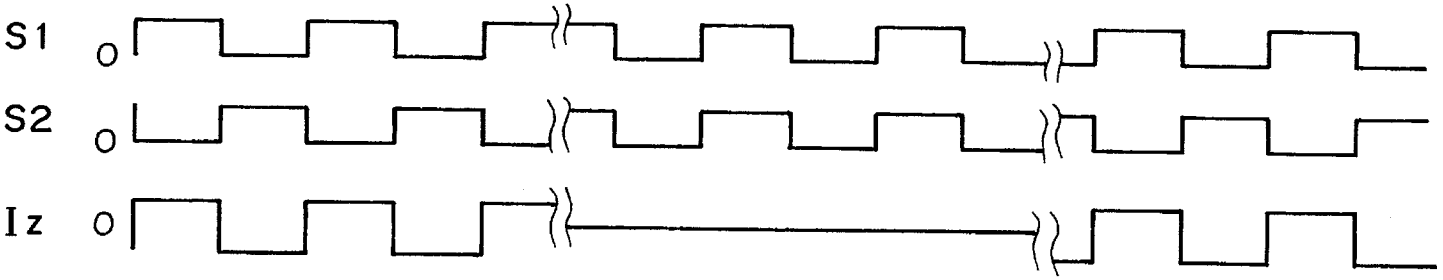
FIG. 12 shows a relationship between the level of the applied voltage in the circuit of FIG. 11 and the direction of the current load.

FIG. 12 shows the relation between the level of the voltage applied to the input terminal and the direction of the load current.

The description will be made as to the case in which from the H state (input terminal S1) and L state (input terminal S2), the level of the input terminal S1 changes to L, and simultaneously, the level of the input S2 changes to H. When the level of the input S1 changes from H to L, the transistor 105 is deactuated. Then, the electric charge accumulated in the base of the transistor 104 is discharged through a resistor R1. Before the transistor 104 is turned off, the base voltage of the transistor 103 rises so that the transistor 103 is turned on. Then, the electric current is supplied to the capacitance C1 connected to the transistor 104, through the transistor 103, so that the transistor 103 is saturated. The gate voltages of the pMOSFET 101 and the nMOSFET 102 increase with the time constant determined by the capacitance C1 connected to the transistor 103 and the saturation resistance of the transistor 103. Then, the pMOSFET 101 is turned off, and the nMOSFET 102 is turned on, so that the level of the output of the transistor Q1 becomes L.

On the other hand, when the level of the input S2 changes from L to H, the transistor 113 is turned on, and the transistor 111 is turned off, and in addition, the transistor 112 is turned on. Then, the gate levels of the pMOSFET 109 and the nMOSFET 110 becomes L. Thus, the pMOSFET 109 is turned on, the nMOSFET 110 is turned off, and the level of the output Q2 is switched to H. Thus, the load current flows from the output Q2 to the input Q1.

The operation when the level of the input S1 changes from L to H, and the level of the input S2 changes from H to L, is essentially the same as in the case in which the level of the input S2 changes from L to H, and the level of the input S1 changes from H to L, that is, the direction of the load current is opposite. Therefore, the detailed description is omitted for simplicity.

However, in the switching circuit of FIG. 11, there may be delay time in the switching on and off time using the MOSFET elements, and therefore, there may be a problem of the lower efficiency and slower operation.

Figure 13:
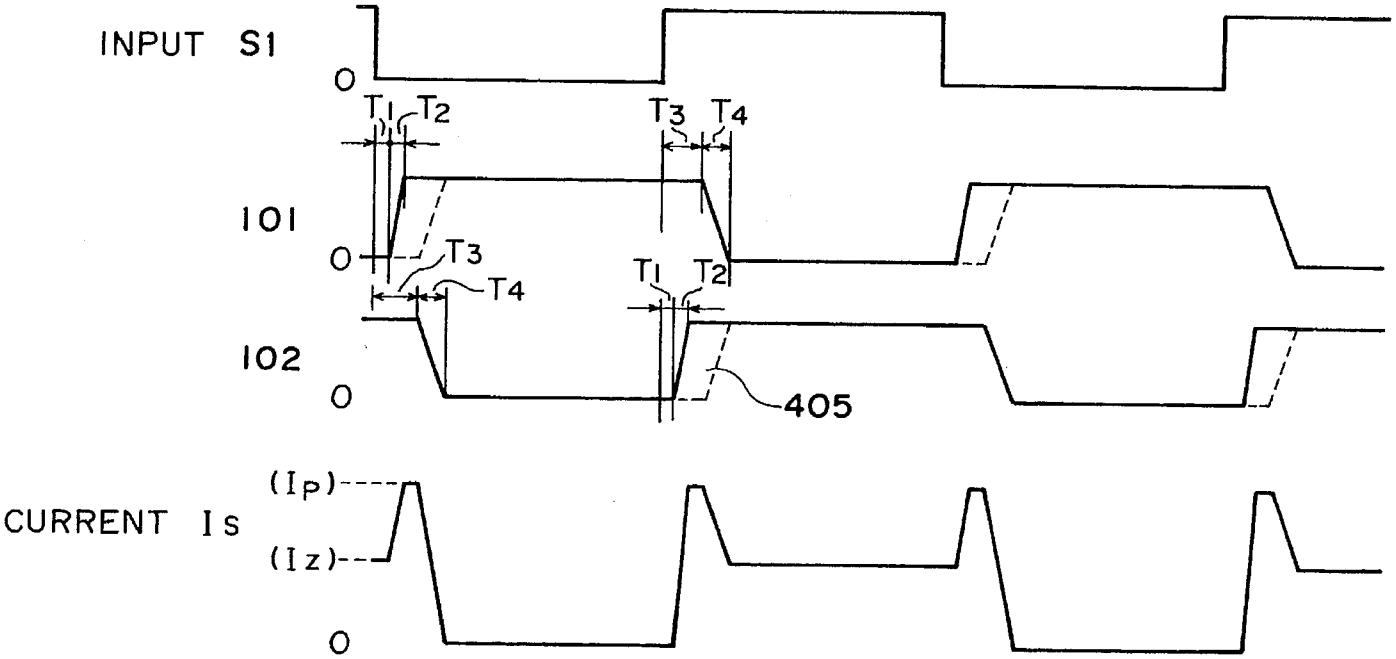
FIG. 13 is a timing chart showing an example of the drive timing of the circuit of FIG. 11.

In FIG. 13, when the level of the input S1 changes from H to L, the pMOSFET 101 is turned off, and the nMOSFET 102 is turned on. At this time, the output waveform of the MOSFET 101 and 102 is as shown in this Figure, in which the delay time is longer in the case of switching on (conductive) than in the case of switching off (disconnect). As a result, in the region 405, both nMOSFETs are conductive, that is, the power source is short-circuited with the ground through the MOSFETs. The current Iz shows the source current during the operation, and it shows the excessive current $I_t$ when the direction of the current reverses.

As described in the foregoing, in order to incorporate into the ink jet recording head, it is desirable that the improvement be made in the durability, reliability and the consumption of ineffective power attributable to the excessive short-circuit current $I_t$ and the switching speed limitation attributable to the time loss in the region 405.

Figure 14:
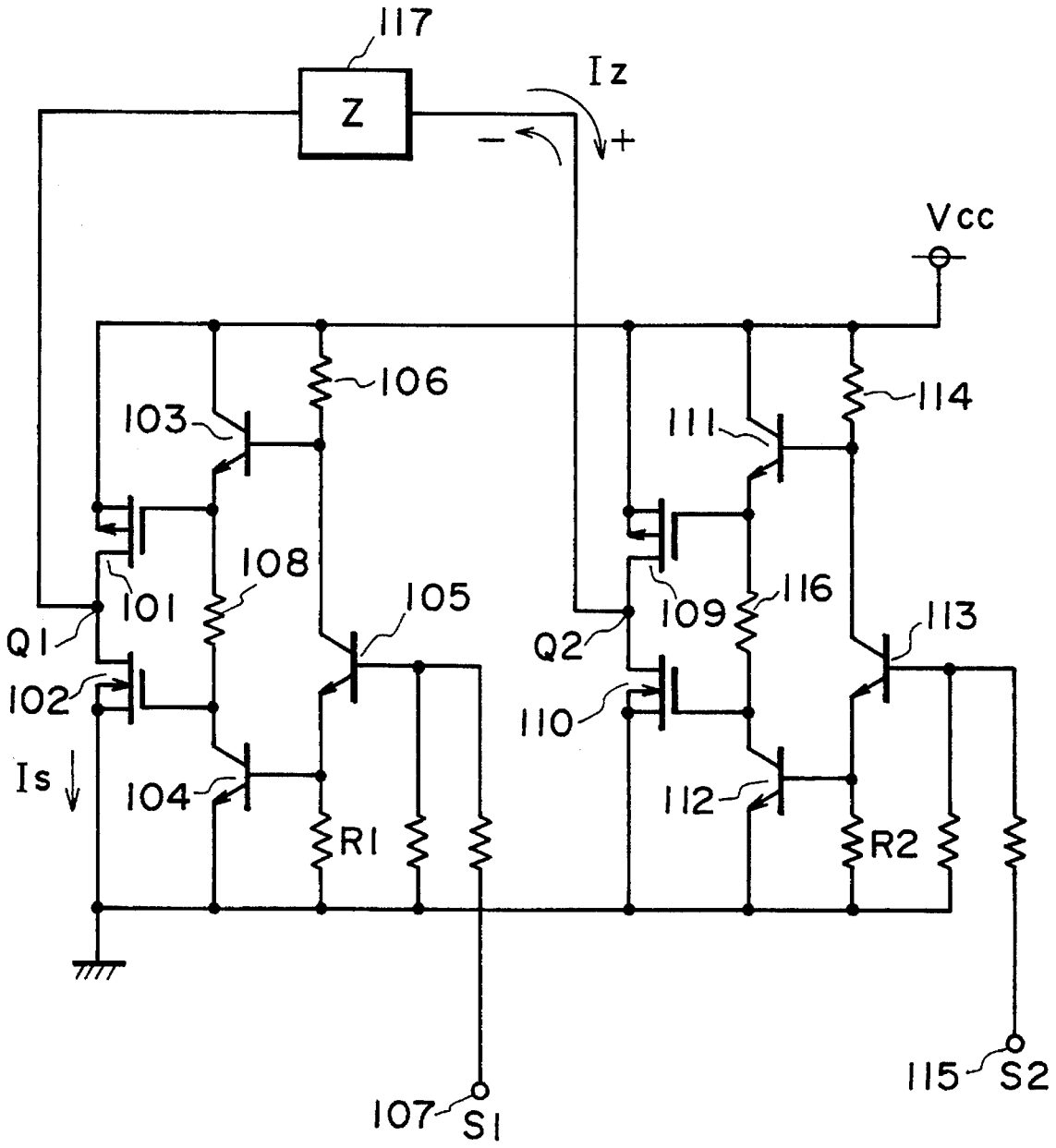
FIG. 14 shows a further example of a circuit diagram of the bi-directional switching circuit used for the output part.

Referring to FIG. 14, an example of a switching circuit which solves these problems, will be described. As compared with the FIG. 11 structure, the structure of this embodiment is different in the totem pole amplifier. In the embodiment of FIG. 11, the npn transistors 103 and 104 are connected in series, and npn transistors 109 and 110 are connected in series. In the present embodiment, the npn transistor 103, the resistor 108 and the npn transistors 104 are connected in series in this order, and the npn transistor 109, the resistor 116 and the npn transistor 110 are connected in series in the order named.

The resistor 108 is effective to control the delay time in the actuation of the MOSFET transistors 101 and 102. The amount of the delay is determined by the time constant which is the internal capacity between the electrodes, inherent to the MOSFET transistors 101 and 102, multiplied by the resistance of the added resistor 108. The resistor 116 is provided for the similar purpose as of the resistor 108.

In order to suppress the variations in the individual MOSFET element, complementary elements are combined, and they are contained in the same package during the manufacturing process. Or, the selected elements having the similar characteristics are bonded. By doing so, the uniform polarities can be provided, and the change in the characteristics due to the thermal junction or the like is suppressed.

Similarly to the case of FIG. 11, description will be made as to the operation in which from the H level state of the input S1 and the low level state of the input S2, the level of the input S1 changes to L, and simultaneously, the level of the input S2 changes to H. By changing the level of the input S1 from H to L, the transistor 105 is turned off. Then, the electric charge accumulated in the base of the transistor 104 is discharged through the resistor R1. Before the transistor 104 is turned off, the voltage of the transistor 103 increases to actuate the transistor 103. Through the transistor 103, the electric current is supplied to the capacitor C1 connected to the transistor 104, so that the transistor 103 is saturated. The gate voltages of the pMOSFET 101 and the nMOSFET 102 increase with the time constant determined by the saturation resistance of the transistor 103, the resistance 108 and the capacitance C1 connected to the transistor 104. Then, the pMOSFET 101 is turned off, and the nMOSFET 102 is rendered on, so that the level of the output Q1 is changed to L.

On the other hand, when the level of the input S2 changes from L to H, the transistor 113 is turned on, and the transistor 111 is turned off, and further the transistor 112 is turned on. Then, the gate levels of the pMOSFET 109 and the nMOSFET 110 change to L. Thus, the pMOSFET 109 is turned on, and the nMOSFET 110 is turned off, so that the level of the output Q2 is changed to H.

The operation when the level of the input S1 changes from L to H, and the level of the input S2 changes from H to L, is essentially the same as the operation when the level of the input S2 changes from L to H, and the level of the input S1 changes from H to L. The difference is in that the direction of the load current is reversed.

Figure 15:
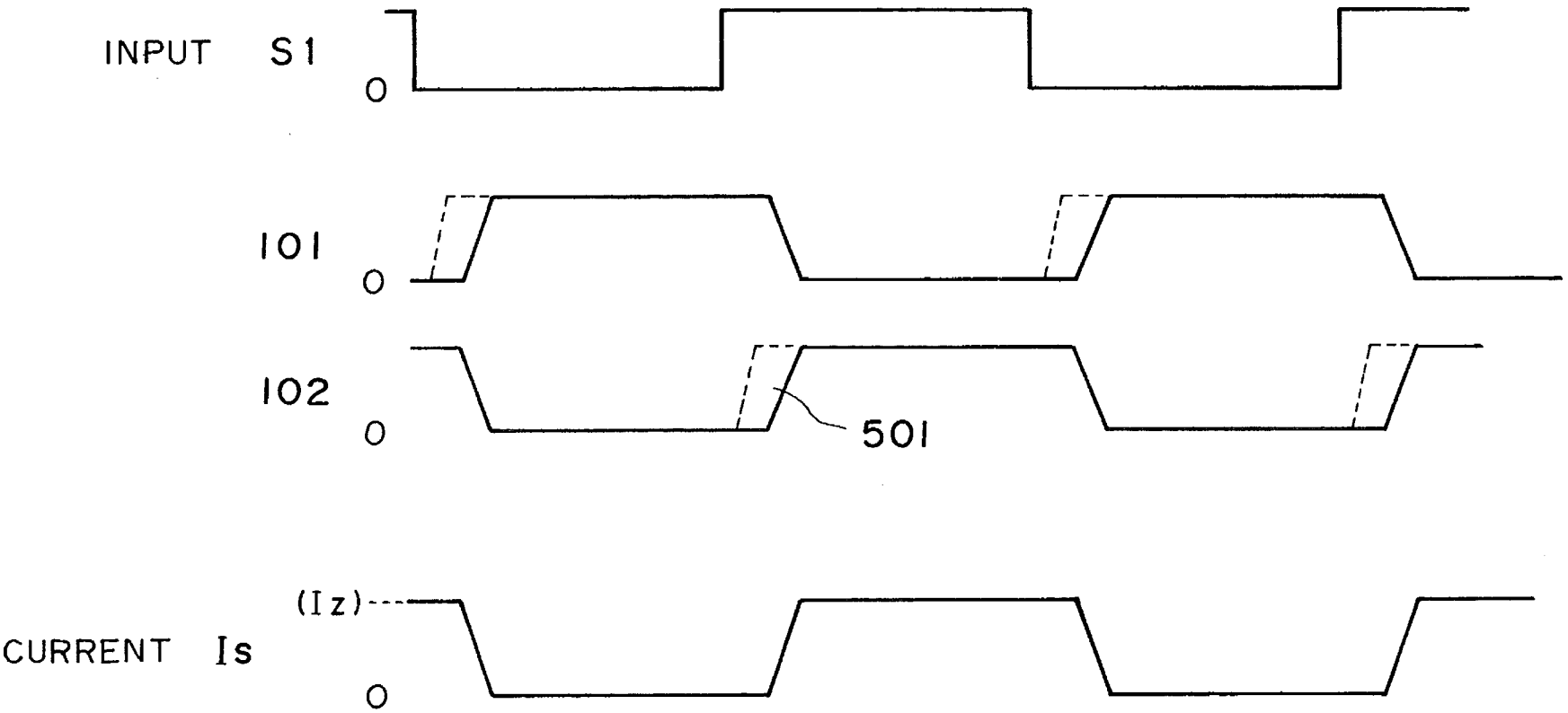
FIG. 15 shows an example of the timing of operations at various parts of FIG. 14.

As will be understood from FIG. 15, the output waveforms of the MOSFET element 101 and 102 are delayed by the resistor 108 in the region 501, so that the on and off timings of the MOSFET elements 101 and 102 are the same. Therefore, the MOSFET elements 101 and 102 will not become conductive simultaneously, thus preventing the excessive source current Iso.

In this embodiment, the first inverter comprises the npn transistor, and the second inverter comprises the pMOSFET and the nMOSFET. However, this structure is not limiting. As an example of an alternative, the inverter may be constituted by MOSFET element, FET element and bipolar transistor.

As described in the foregoing, according to this embodiment, the on-delay-period of the MOSFET element is controlled so that the short-circuit period between the power source and the ground through the output MOSFET element upon the switching operation, can be reduced or suppressed. Therefore, the high speed switching operation is permitted. In addition, the durability and the reliability are improved by the improvement in the efficiency and by the prevention of damage to the elements due to excessive current or the heat generation.

The ink jet recording apparatus using thermal energy and using the switching circuit described above, will be described.

Figure 16:
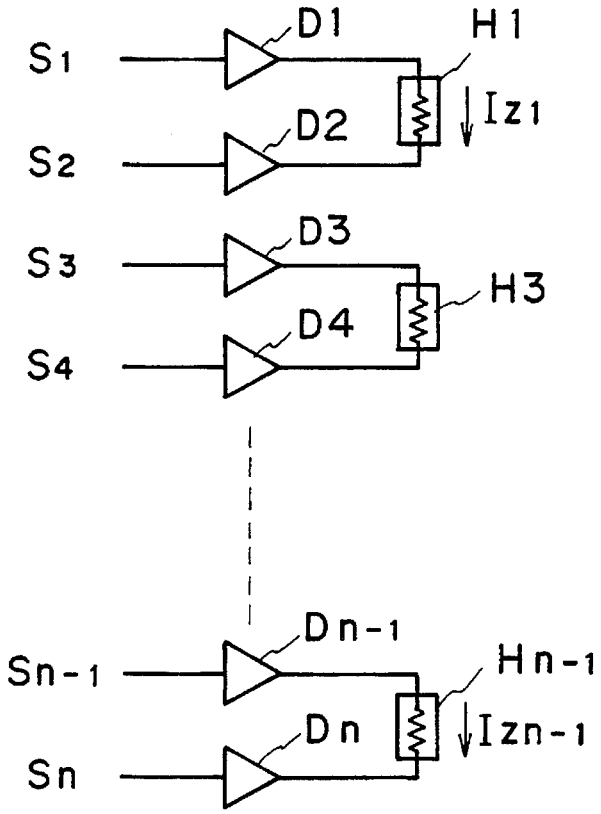
FIG. 16 illustrates an example of a heater driving method for an ink jet type recording head.
Figure 17:
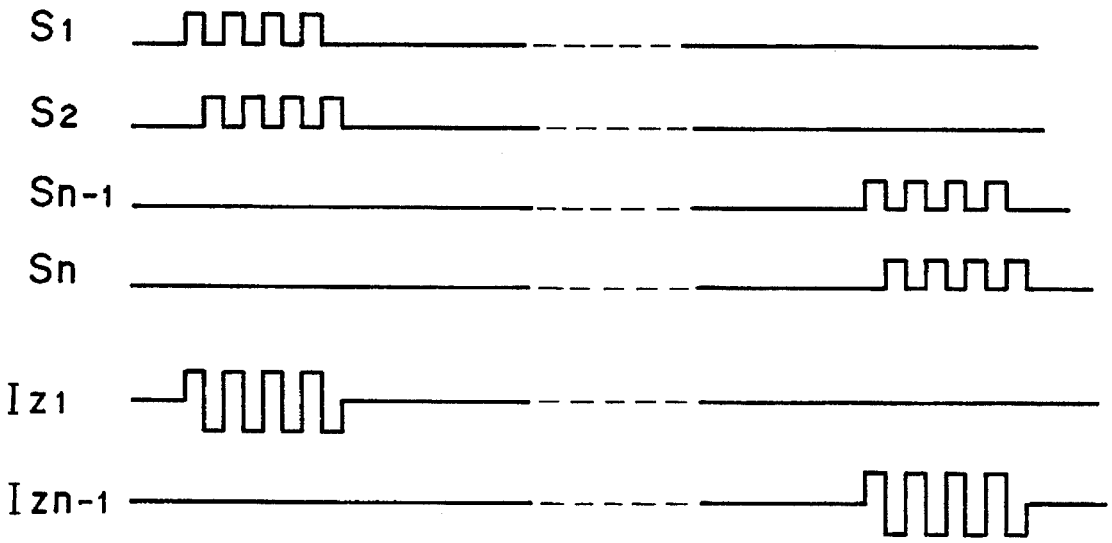
FIG. 17 is a timing chart showing an example of the timing of operations at various parts of the circuit of FIG. 16.

FIG. 16 shows an example of a driving circuit using the same. In this embodiment, the loads in the form of heaters H1, H3, . . . , and Hn-1 are driven by the driving circuits D1, D2, the driving circuit D3, D4, . . . , the driving circuits Dn-1, Dn. The inputs S1, S2, the inputs S3, S4, . . . , inputs Sn-1, Sn, are supplied sequentially with the signals shown in FIG. 17, so that the heaters H1, H3, . . . , Hn-1 are supplied with the load currents Iz1, Iz3, . . . , and Izn-1. Thus, the heater is DC-current driven. In this embodiment, the heater damage attributable to the electrochemical reaction produced between the heater and the ink contacted thereto when the heater is DC-driven, is prevented. The period in which the driving current is supplied is approximately 5 micro-sec, and it is supplied for 4–8 clock cycles.

Figure 18:
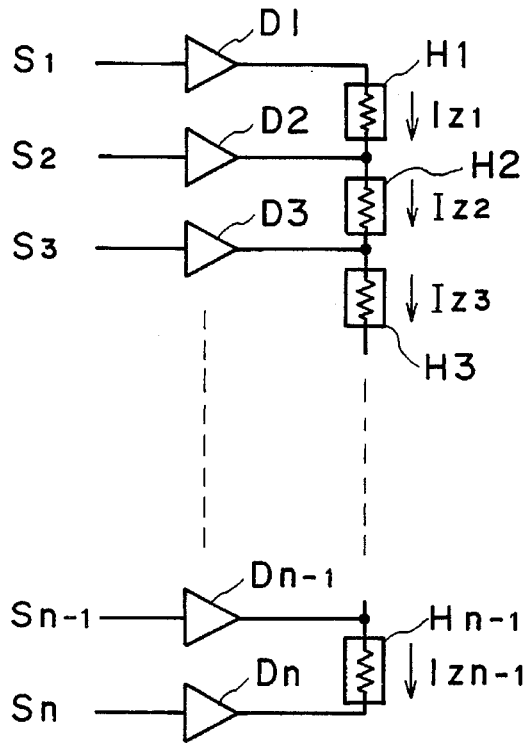
FIG. 18 illustrates another example of the heater driving method in an ink jet type recording head.
Figure 19:
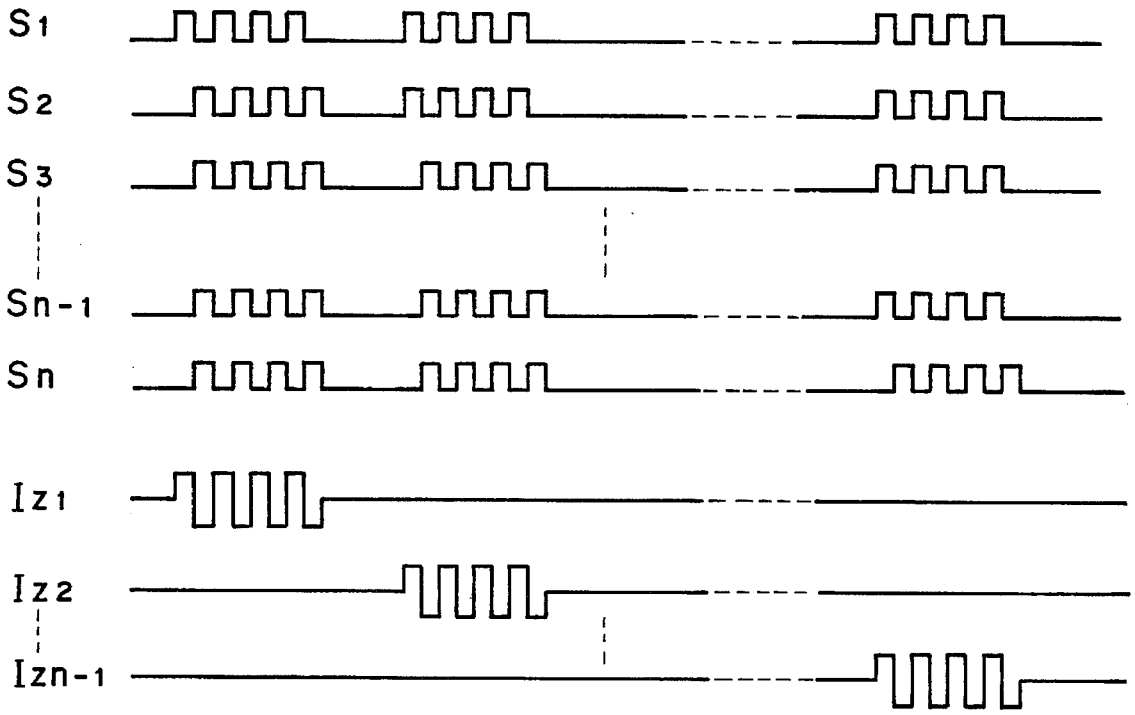
FIG. 19 is a timing chart of an example of the timing at various parts of the circuits shown in FIG. 18.

FIG. 18 shows another example of the ink jet type recording head. In this embodiment, the driving circuits D1, . . . , Dn are connected to the respective opposite end of the heaters H1, . . . , Hn connected in series. The driving circuit D2 is connected to the node between the heaters H1 and H2, the driving circuit D3 is connected to the node between the heaters H2 and H3, and the driving circuit Dn-1 is connected to the node of the heaters Hn-2 and Hn-1. The inputs S1, S2, . . . , Sn are supplied with the signals shown in FIG. 19. For example, in order to flow the current Iz1 in the heater H1, the phases of the signal supplied to the input S1 and the signals supplied to the inputs S2–Sn, are made opposite. Thereafter, the signals as shown in the Figure are sequentially applied. Then, the driving currents Iz2, . . . , Izn-1 flow. Therefore, the heater damage attributable to the electrochemical reaction between the heater and the ink contacted thereto when the heater is DC-current driven, can be prevented.

An example of the recording head of the ink jet type has been described, but the present invention also applicable to a thermal transfer type recording head.

This is also applicable with a high speed bi-directional driving circuit for stepping motors and linear motors and also to a high speed driving circuit for a liquid crystal.

As described in the foregoing, according to the present invention, the stabilized operational speed can be increased, and the efficiency is improved.

The present invention is particularly suitably usable in an ink jet recording head and recording apparatus wherein thermal energy generated by an electrothermal transducer, laser beam or the like is used to cause a change of state of the ink to eject or discharge the ink. This is because the high density of the picture elements and the high resolution of the recording are possible.

The typical structure and operational principles are preferably as disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from the nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increase rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 38461/1984 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, with the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet faces the electrothermal transducers. The most effective of the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording head comprising:

a plurality of heat generating elements for ejecting an ink using thermal energy, wherein each said heat generating element has an end;

selecting means for selecting image signals to eject the ink by supplying currents to corresponding heat generating elements at at least two timings, so that said heat generating elements are classified into at least two blocks actuated at different timings, and adjacent said heat generating elements belong to different blocks;

a plurality of conductive lines, each said conductive line being commonly connected to said end of a given said heat generating element and to an end of an adjacent said heat generating element; and a driving circuit for selectively providing current to each of the lines commonly connected, in accordance with the image signals selected by said selecting means, said driving circuit actuating a given said heat generating element by applying a high level potential and a low level potential to adjacent lines for said given heat generating element, respectively.

2. A recording head according to claim 1, further comprising a reference line for determining the potential level of the conductive lines, wherein a potential of the reference line is changeable.

3. A recording head according to claim 1, wherein the ink is ejected by creation of a bubble caused by film boiling by thermal energy applied by said heat generating element.

4. A head according to claim 1, wherein a block to be driven is selected by a selection signal.

5. A head according to claim 4, wherein the selection signal is an enabling signal.

6. A head according to claim 1, wherein said heat generating elements and said conductive lines are formed on a substrate.

7. A head according to claim 6, wherein the substrate comprises silicon.

8. A head according to claim 6, wherein said heat generating elements comprise TaAl.

9. A head according to claim 6, wherein a protective layer is disposed on the heat generating elements and the conductive lines.

10. A head according to claim 6, wherein no protective layer is disposed on the heat generating elements and the conductive line so as to allow said ink to contact the heat generating elements and the conductive lines.

11. A head according to claim 1, wherein said recording head ejects inks of different colors.

12. A head according to claim 1, wherein said recording head has a width equal to a width of a recording material.

13. A head according to claim 1, wherein said recording head scans the recording material.

14. A head according to claim 2, wherein a potential of the reference line changes during driving operation.

15. A head according to claim 2, wherein a particular block which is to be driven is selected by a selection signal, and the potential of said reference line changes in synchronism with the selection signal.

16. A head according to claim 2, wherein the potential of said reference line changes for each recording of an image signal.

17. A recording head according to claim 1, wherein said driving circuit provides a current which has one of positive and negative polarity.

18. An ink jet recording head comprising:

a plurality of resistors connected in series, said resistors generating thermal energy, wherein each said resistor has an end;

selecting means for selecting image signals to eject the ink by supplying currents to corresponding resistors at at least two timings, so that said resistors are classified into at least two blocks actuated at different timings, and adjacent resistors belong to different blocks;

a plurality of lines connected to opposite ends of the resistors, each of said lines being common for adjacent said resistors; and a driving circuit for selectively providing current to the common lines, in accordance with the image signals selected by said selecting means, said driving circuit selectively applying a high level potential to one end of said resistors and a low level potential to another end of said resistors.

19. A recording head according to claim 18, further comprising a reference line for determining a potential level of the conductive lines, wherein a potential of the reference line is changeable.

20. A recording head according to claim 18, wherein a ink is ejected by creation of a bubble caused by film boiling by thermal energy applied by said resistor.

21. A recording head according to claim 18, wherein said driving circuit provides a current which has one of positive and negative polarity.

22. An ink jet recording apparatus comprising:

a plurality of heat generating elements for ejecting ink using thermal energy, said heat generating elements having ends;

selecting means for selecting image signals to eject the ink by supplying currents to corresponding heat generating elements at at least two timings, so that said heat generating elements are classified into at least two blocks actuated at different timings, and adjacent heat generating elements belong to different blocks;

a plurality of conductive lines, each said conductive line being commonly connected to said end of a given said heat generating element and to another said end of an adjacent said heat generating element;

a driving circuit for selectively providing current to the lines commonly connected, in accordance with the image signals selected by said selecting means, said driving circuit actuating said heat generating elements by applying a high level potential and a low level potential to adjacent said lines, respectively; and switching means for selectively applying the low level and the high level potentials.

23. A recording apparatus according to claim 22, wherein the ink is ejected by creation of a bubble caused by film boiling by thermal energy applied by said heat generating element.

24. A recording apparatus according to claim 22, wherein said driving circuit provides a current which has one of positive and negative polarity.

25. A recording apparatus comprising:

an ink jet recording head including a plurality of heat generating elements for ejecting ink using thermal energy;

selecting means for selecting image signals to eject the ink by supplying currents to corresponding heat generating elements at at least two timings, so that said heat generating elements are classified into at least two blocks actuated at different timings, and adjacent heat generating elements belong to different blocks;

a plurality of conductive lines, each said line being commonly connected to an end of each of a given said heat generating element and to another end of an adjacent said heat generating element; and a driving circuit for selectively providing current to the common lines, in accordance with the image signals selected by said selecting means, said driving circuit actuating said heat generating elements by applying a high level potential and a low level potential to adjacent said lines, respectively;

a recording head mounting portion for mounting said recording head; and feeding means for feeding a recording material to be subjected to a recording operation by said recording head.

26. An apparatus according to claim 25, wherein the ink is ejected by a creation of a bubble by film boiling by thermal energy generated by said heat generating element.

27. A recording apparatus according to claim 25, wherein in said recording head said driving circuit provides a current which has one of positive and negative polarity.

28. An ink jet recording apparatus comprising:

an ink jet recording head including plural resistors connected in series, said resistors generating thermal energy and said resistors having ends;

selecting means for selecting image signals to eject the ink by supplying currents to corresponding resistors at at least two timings, so that said heat generating elements are classified into at least two blocks actuated at different timings, and adjacent heat generating elements belong to different blocks;

a plurality of lines connected to opposite ends of the resistors, said lines being commonly connected to adjacent resistors; and a driving circuit for selectively providing current to the common lines, in accordance with the image signals selected by said selecting means, said driving circuit applying a high level potential to one of the ends of each of said resistors and a low level potential to the other ends of each of said resistors; and switching means for selectively applying the low level potential and the high level potential.

29. An apparatus according to claim 28, wherein said driving circuit comprises a bi-directional current switching circuit including complementary switching elements and an impedance element for controlling on and off timing of the complementary switching elements.

30. A recording apparatus according to claim 28, wherein in said recording head said driving circuit provides a current which has one of positive and negative polarity.

* * * * *

UNITED STATES PATENT AND TRADEMARK OFFICE

CERTIFICATE OF CORRECTION

PATENT NO. : 5,504,505

DATED : April 2, 1996

INVENTOR(S) : YASUYUKI TAMURA ET AL.

It is certified that error appears in the above-identified patent and that said Letters Patent is hereby corrected as shown below:

COLUMN 1

Line 50, "reaction" should read --reactions--.
Line 52, "reaction," should read --reactions,--.
Line 54, "the" should be deleted.
Line 62, "limitations" should read --limitations to--.
Line 64, "the" should be deleted.

COLUMN 2

Line 32, "by" should read --of--.
Line 33, "of" should read --by--.

COLUMN 3

Line 53, "and by changing" should read --by changing--.
Line 54, "may be" should be deleted.
Line 64, "the caused" should read --the problem caused--.

COLUMN 5

Line 31, "covering" should be deleted.
Line 60, "heat" should read --heat generating--.

UNITED STATES PATENT AND TRADEMARK OFFICE

CERTIFICATE OF CORRECTION

PATENT NO. : 5,504,505

DATED : April 2, 1996

INVENTOR(S) : YASUYUKI TAMURA ET AL.

It is certified that error appears in the above-identified patent and that said Letters Patent is hereby corrected as shown below:

COLUMN 7

Line 35, "of" should read --that--.
Line 58, "This" should read --this--.

COLUMN 9

Line 26, "immediately" should read --immediate--.
Line 64, "on" should be deleted.

COLUMN 11

Line 17, "becomes" should read --become--.

COLUMN 16

Line 45, "a ink" should read --an ink--.

Signed and Sealed this

First Day of October, 1996

Bruce Lehman

*Attest:*

BRUCE LEHMAN

*Attesting Officer*

*Commissioner of Patents and Trademarks*